US006609738B1

(12) United States Patent
Roth et al.

(10) Patent No.: US 6,609,738 B1
(45) Date of Patent: Aug. 26, 2003

(54) ELECTROMAGNETIC DOOR LOCK SYSTEM

(75) Inventors: Thomas Roth, Reno, NV (US); Dennis Wojdan, Sparks, NV (US); Vincent Fralliciardi, Reno, NV (US); Robert Cook, Sparks, NV (US)

(73) Assignee: Securitron Magnalock Corp., Sparks, NV (US)

( * ) Notice: Subject to any disclaimer, the term of this patent is extended or adjusted under 35 U.S.C. 154(b) by 0 days.

(21) Appl. No.: 09/427,503

(22) Filed: Oct. 26, 1999

Related U.S. Application Data

(63) Continuation-in-part of application No. 08/831,069, filed on Apr. 1, 1997, now abandoned, which is a continuation-in-part of application No. 08/603,649, filed on Feb. 20, 1996, now Pat. No. 5,758,913.

(51) Int. Cl.[7] ..... E05C 17/56

(52) U.S. Cl. ..... 292/251.5; 292/92; 292/144; 292/DIG. 61

(58) Field of Search ..... 292/251.5, 92, 292/144, 177, DIG. 61; 70/92

(56) References Cited

U.S. PATENT DOCUMENTS

| | | | | |
|---|---|---|---|---|
| 2,530,628 A | | 11/1950 | Pivero | 292/144 |
| 2,693,382 A | | 11/1954 | Teetor | 292/251.5 |
| 2,727,772 A | | 12/1955 | Hamilton | 292/144 |
| 2,877,041 A | | 3/1959 | Foley | 292/251.5 |
| 3,060,786 A | | 10/1962 | Flower | 292/251.5 |
| 3,258,285 A | | 6/1966 | Smith | 292/251.5 |
| 3,576,119 A | | 4/1971 | Harris | 292/144 |
| 3,843,174 A | | 10/1974 | Bogunovich et al. | 292/144 |
| 4,022,509 A | | 5/1977 | Bopp et al. | 296/28 |
| 4,257,631 A | | 3/1981 | Logan, Jr. | 292/251.5 |
| 4,314,722 A | | 2/1982 | Logan, Jr. | 292/263 |
| 4,487,439 A | * | 12/1984 | McFadden | 292/251.5 |
| 4,609,910 A | | 9/1986 | Geringer et al. | 340/545 |
| 4,652,028 A | | 3/1987 | Logan et al. | 292/251.5 |
| 4,682,801 A | | 7/1987 | Cook et al. | 292/263 |
| 4,703,962 A | | 11/1987 | Kelly et al. | 340/545 |
| 4,720,128 A | | 1/1988 | Logan, Jr. et al. | 292/251.5 |
| 4,915,431 A | | 4/1990 | Bailey | 292/251.5 |
| 5,016,929 A | | 5/1991 | Frolov | 292/251.5 |
| 5,065,136 A | | 11/1991 | Frolov et al. | 340/545 |
| 5,139,293 A | | 8/1992 | Zimmerman et al. | 292/251.5 |
| 5,184,855 A | * | 2/1993 | Waltz et al. | 292/251.5 |

(List continued on next page.)

FOREIGN PATENT DOCUMENTS

| | | | |
|---|---|---|---|
| DE | 24 38 312 | 2/1976 | |
| EP | 21611 | 1/1981 | 340/547 |
| FR | 424974 | 3/1911 | 292/144 |
| FR | 1180547 | 12/1958 | |
| FR | 2621349 | 4/1989 | 292/144 |
| JP | 38757 | 3/1977 | 292/251.5 |
| JP | 52-38757 | 3/1977 | |

*Primary Examiner*—Suzanne Dino Barrett
(74) *Attorney, Agent, or Firm*—Oppenheimer Wolff & Donnelly LLP

(57) ABSTRACT

An electromagnetic door lock system, allowing emergency exiting of a building, including an armature mount allowing considerable outward movement of the door with respect to the door frame on which the electromagnet is mounted, whereby outward movement of the door initiates a time delay door release, and gives an increased reassurance that the door will open in an emergency, and allows for improved tamper resistance and reduced false alarms, as the distance the door opens out of the door frame in response to actuation of a panic bar from within is greater than that of conventional systems. A tamper resistant door position sensor includes redundant magnetic reed switches for sensing the position of the door and can include an additional reed switch for detecting when an external magnet is placed near the sensor in an attempt to tamper with the system.

35 Claims, 11 Drawing Sheets

U.S. PATENT DOCUMENTS

| | | | | | |
|---|---|---|---|---|---|
| 5,184,856 | A | | 2/1993 | Waltz | 292/251.5 |
| 5,380,053 | A | | 1/1995 | Saino | 292/144 |
| 5,429,399 | A | | 7/1995 | Geringer et al. | 292/92 |
| 5,479,151 | A | | 12/1995 | Lavelle et al. | 292/251.5 |
| 5,496,079 | A | | 3/1996 | Frolov | 292/251.5 |
| 5,641,187 | A | | 6/1997 | Frolov | 292/251.5 |
| 5,668,533 | A | | 9/1997 | Jackson, Jr. et al. | 340/547 |
| 5,758,913 | A | | 6/1998 | Roth et al. | 292/251.5 |
| 5,897,149 | A | * | 4/1999 | Frolov | 292/251.5 |
| 5,937,487 | A | * | 8/1999 | Bauer | 292/251.5 X |
| 6,007,119 | A | * | 12/1999 | Roth et al. | 292/251.5 |
| 6,053,546 | A | * | 4/2000 | Frolov | 292/251.5 |
| 6,135,515 | A | * | 10/2000 | Roth et al. | 292/251.5 |
| 6,260,892 | B1 | * | 7/2001 | Chang | 292/251.5 |

* cited by examiner

FIG. 1
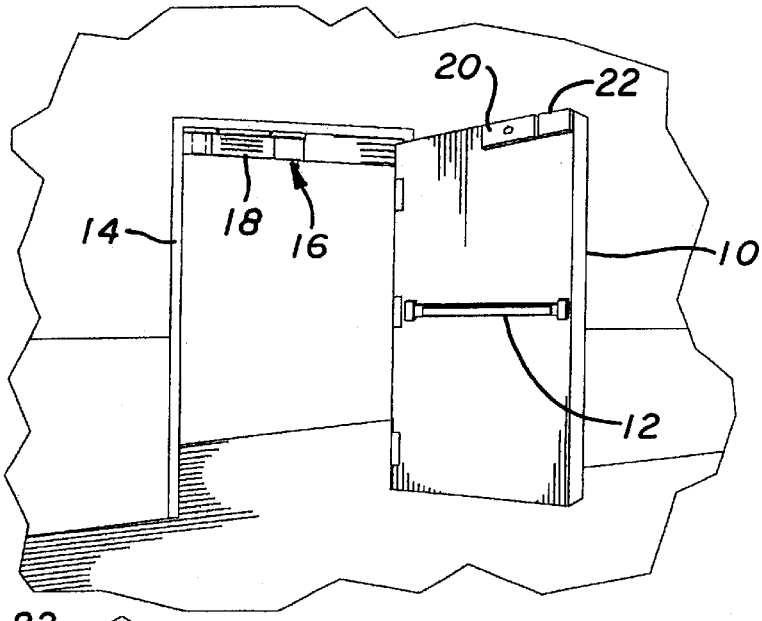
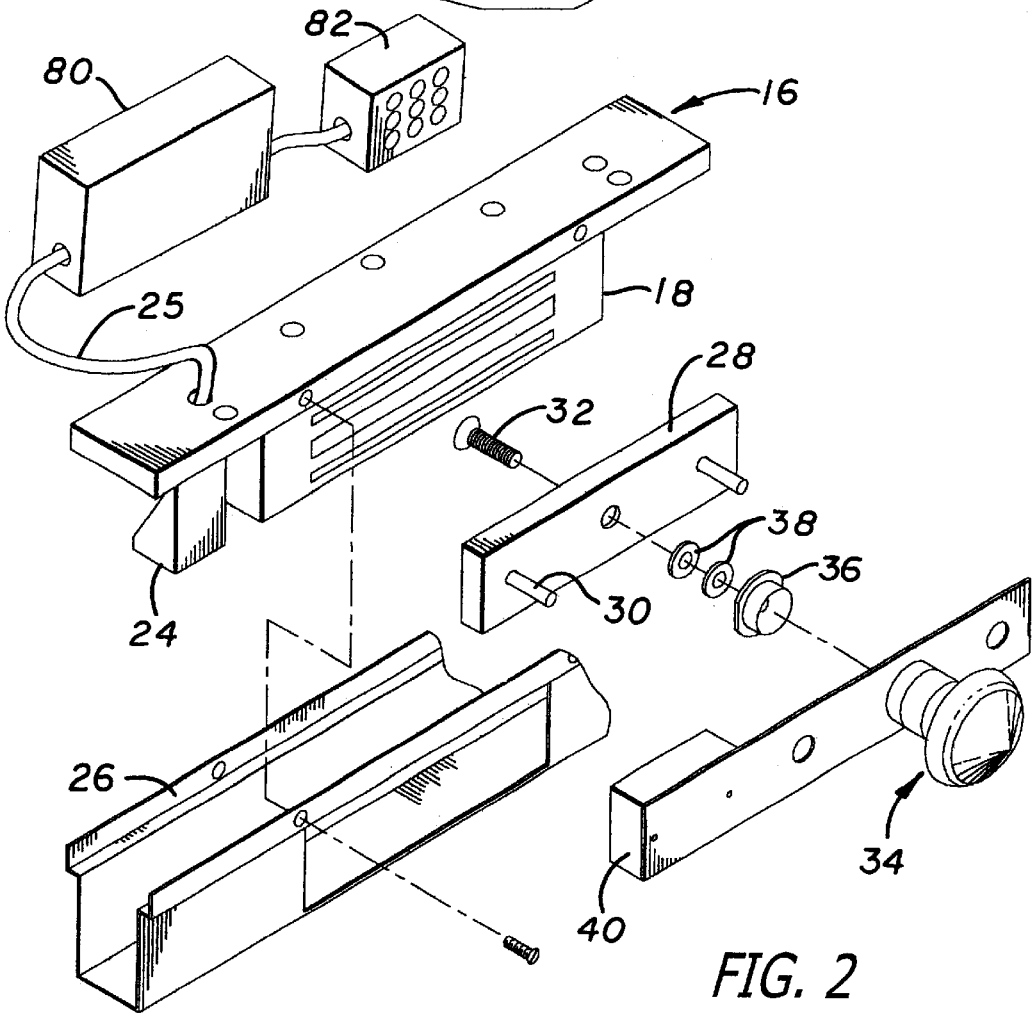
FIG. 2

FIG. 9
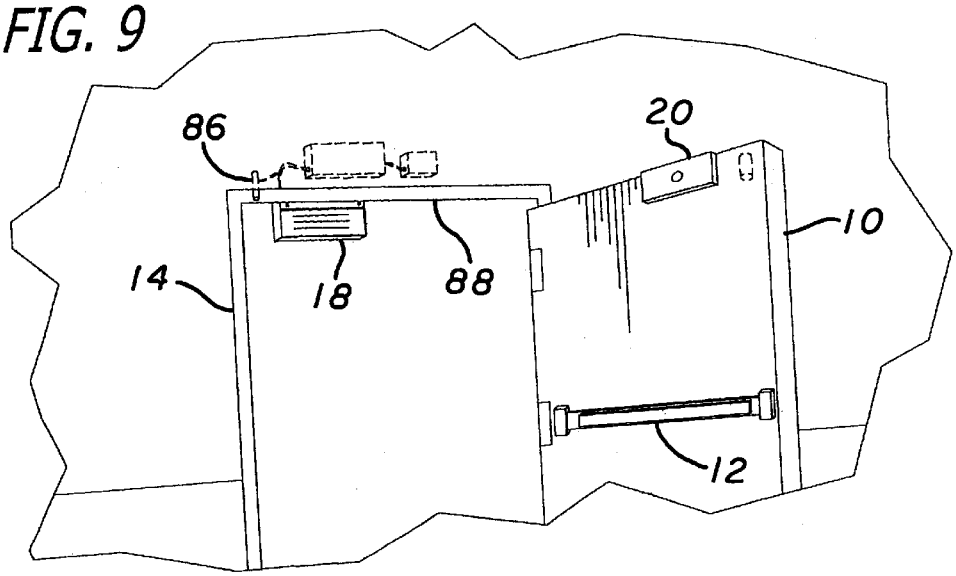
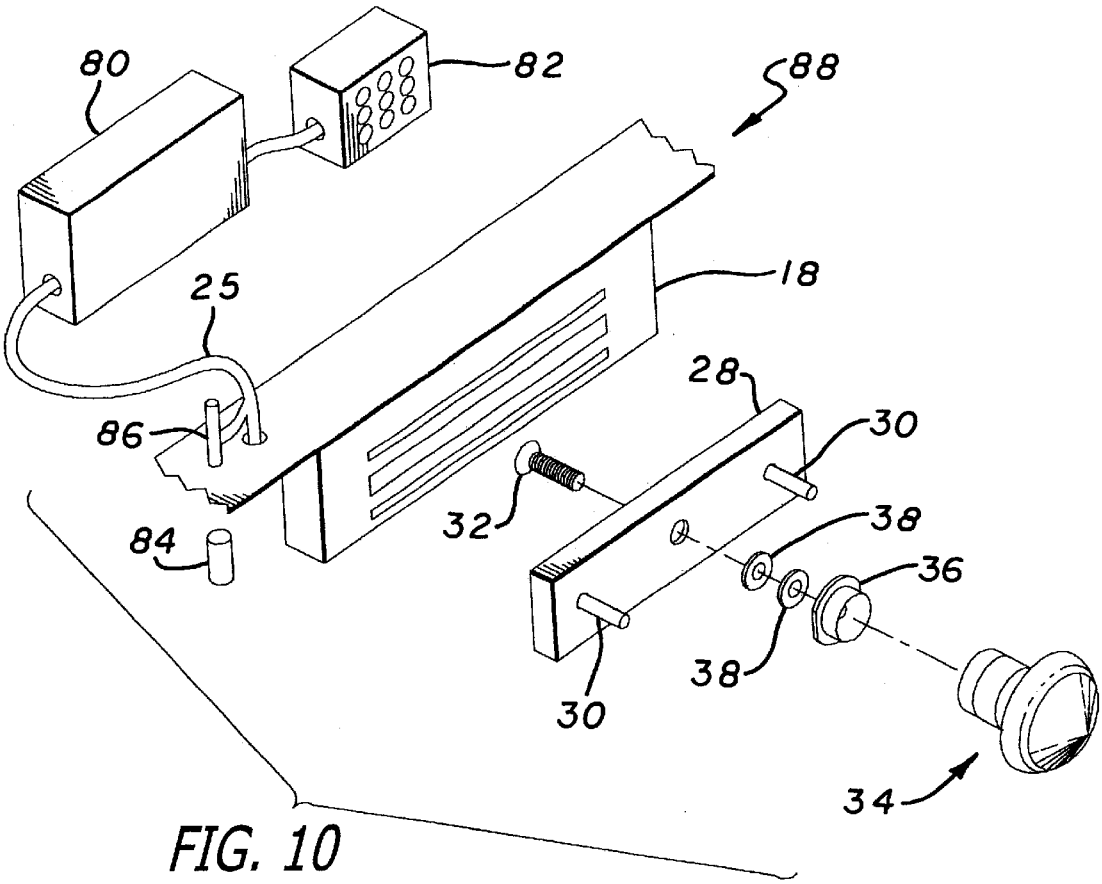
FIG. 10

ELECTROMAGNETIC DOOR LOCK SYSTEM

RELATED APPLICATIONS

This application is a continuation in part of U.S. patent application Ser. No. 08/831,069 filed Apr. 1, 1997, now abandoned which is a continuation in part of U.S. patent application Ser. No. 08/603,649 filed Feb. 20, 1996 now U.S. Pat. No. 5,758,913.

BACKGROUND OF THE INVENTION

1. Field of the Invention

The field of the present invention relates to electromagnetic emergency exit door lock systems. More particularly, the present invention relates to tamper-resistant time delay emergency exit electromagnetic door lock systems.

2. Description of the Related Art

Electromagnetic locks are commonly used in "delayed exit" systems. The purpose of a delayed exit system is to allow people to exit a building immediately in the event of an emergency, or after a 15 to 30 second delay in a non emergency situation while at the same time providing an acceptable measure of security against unauthorized entry or exit. Typically, a person who wishes to exit in an emergency activates the door by pressing down on a spring biased push bar sometimes called a "panic bar" mounted on the door. Alternately a lever or door knob may be turned. This initiates an audible alarm. If the person maintains the initiate signal by holding the panic bar down for the duration of a "nuisance delay" period which is typically 1 to 3 seconds, the system will then begin a delay known as an irrevocable release or egress delay. At the end of the egress time delay the door will open. The egress time is typically 15 or 30 seconds under most building codes.

The purpose of the nuisance delay is to cope with accidental striking of the door or push bar. When someone inadvertently presses against the push bar, an audible alarm warns the person away from the door. If the initiate signal is maintained for less than the duration of the nuisance delay period, the door will "reset" when the initiate signal stops and will therefore not release at the end of the 15 or 30 seconds. This maintains security and also saves building staff from the necessity of going to the door and re-locking it if it had released. The nuisance delay concept was intended to not only deal with accidental striking of the door, but with casual vandalism as might be expected from young persons who would push the door, hear the alarm, and then run away. On the other hand, if the initiate signal is maintained for longer than the nuisance delay period, release after 15 or 30 seconds becomes irrevocable. Such systems are in broad use, particularly in retail establishments where they greatly reduce theft loss while complying with building codes that require a minimum number of emergency exits.

One of the earliest electromechanical delayed exit systems is disclosed in U.S. Pat. No. 4,257,631 issued to Logan. Logan discloses a switch located within a push bar mounted on the door to sense when somebody attempts to exit the building. There are two significant drawbacks to this design. First, on existing doors a push bar is already present so it must be replaced at relatively high cost with a push bar equipped with a switch. Second, the wires to the switch within the push bar must be routed from the door to the frame which carries the electromagnetic lock. This requires either an electric hinge which is costly to purchase and install, or a "door cord" which is looped between the door and frame. Such door cords invite vandalism as the wiring is exposed.

U.S. Pat. No. 4,609,910 issued to Geringer discloses a delayed exit system in which two bolts which mount the armature plate to the door are allowed slack in their holes. When the door is pushed, the door can move slightly, thereby taking up this slack. The door remains securely held by the electromagnetic lock but the slight motion can be detected by a plunger type switch. The switch initiates the delay without the need to supply a switch equipped push bar or to route wires into the door.

One problem with this system is that it is prone to false initiation. To avoid having to precisely align the door and the door frame, the push bar-activated latch is often allowed a significant amount of slack within its securing recess. Wind or vandals rattling the door can take up the slack provided in the bolts of Geringer, thereby activating the switch and initiating the delay even though a person had not intended to exit. This constitutes a type of "false alarm".

A further drawback of this design is that it is vulnerable to tampering. The plunger switch can be taped down such that the switch is incapable of recognizing when the door has been pushed away from its fully closed position in an effort to exit the building. This type of tampering may be performed by building guards for example who desire to increase security at the expense of egress safety, or who do not wish to have to check on the door when it is activated, either by someone who has exited or by a false initiation. This creates a hazardous and potentially fatal situation.

A similar design is disclosed in U.S. Pat. No. 4,652,028 issued to Logan et al. As in the Geringer design, slack is created by the use of bolts whose heads fit loosely within the armature plate. This design is prone to similar false initiations. Since the Logan et al. design uses a Hall effect sensor to detect the slight movement of the door provided by the slack in the bolts, the mechanism cannot be overridden by the use of tape. However, the system may still be tampered with by the application of an external magnet, which can disrupt the operation of the Hall effect sensor.

A further design is illustrated in U.S. Pat. No. 4,915,431 issued to Bailey. As in Geringer, Bailey employs a mechanical plunger switch, but the switch is positioned in the center of the armature which makes it relatively immune to tampering. As in Geringer, the slack that allows door movement is created by allowing mounting bolt heads to move slightly within the armature. This design is also vulnerable to false initiation by rattling of the door caused by wind or vandals.

A still further design is illustrated in U.S. Pat. No. 5,065,136 issued to Frolov et al. In this design, the electromagnet body is permitted to pivot slightly in response to pressure on the door. The rotational action of the top of the electromagnet creates a small gap between the electromagnet top and the door header which permits a spring biased switch to change state by its trigger moving into the gap. This design is also prone to tampering. Someone working within the facility can temporarily pivot the electromagnet body down and insert a piece of tape to prevent the switch from moving into the gap. This would prevent the switch from being triggered by movement of the door.

An armature mount assembly is disclosed in U.S. Pat. No. 5,184,856, issued Feb. 9, 1993 to Waltz. The disclosure teaches a mount that allows the armature to be pulled outward from the door a small distance to contact an electromagnet mounted to the door frame. However, there is no teaching of an armature mount that allows the door to be opened outwardly a considerable distance while the armature is held against the electromagnet.

SUMMARY OF THE INVENTION

Accordingly, it is a general object of this invention to provide a delayed exit door control system that can be economically implemented for retrofit applications.

It is a further object of the invention to provide a delayed exit door control system that is resistant to false initiations by rattling caused by wind or vandals.

It is a further object of the invention to provide a delayed exit door control system that is resistant to tampering, either from casual vandals or by personnel within the facility.

It is also an object of the invention to overcome disadvantages of the prior art.

To achieve these and other objects, the present invention includes an electromagnet mounted to a door frame, an electromagnet armature mounted to a door facing the electromagnet, and an armature mount allowing considerable outward movement of the door with respect to the frame while the armature is held against the electromagnet. One way of doing this is by providing an armature mounting bolt (sometimes referred to as a "sex bolt" within the industry) that includes a novel internal spring biased plunger to which the armature is mounted. The spring biased plunger extends out the back of the armature mounting bolt, and is threaded so that the armature may be mounted directly to the back of the plunger. The spring allows the armature to be pulled away from the armature mounting bolt as for example by someone pushing on the door to initiate a delayed exit sequence, and return towards the bolt once the external force is removed.

The spring provides a bias force to assist in the return of the door to its fully closed position in the event that someone intentionally or unintentionally pushes the panic bar on the door, causing the door to open to its activation position momentarily and hence initiating the nuisance delay. Provided that the vandal or other person releases the door before the end of the nuisance delay period, the door will be assisted in returning to its fully closed position, and the door will remain locked. This provides a significant advantage over prior art systems that lack a mechanism for positively returning the door to its fully closed position, as for example systems that employ slack in mounting bolts.

The spring biased plunger of the present invention moves within the space of the armature mounting bolt, which is mounted through a hole in the door. The plunger therefore can move through the volume defined by the door, as much as the entire thickness of the door and even more if the armature bolt hollow interior is allowed to be longer than the thickness of the door. This provides a much greater travel distance than was possible with prior art systems that relied on slack movement of mounting bolts within the volume of the armatures themselves. Since conventional armatures are typically steel plates on the order of one-half inch (1.27 cm) thick, the prior art systems were limited to significantly less than that amount of movement (on the order of ⅛" or 3 mm). With the present invention, the door movement distance required for activation can be set at a sufficient distance that mere rattling of the door within the panic bar latch cannot initiate the system. Rather, the panic bar latch must be released and the door pushed by an individual a sufficient distance to activate the system. For example, on a 1 ¾" (44.45 mm) door, the most common commercial door thickness, the present invention permits door movement of up to 1.1" (28 mm). This amount of movement is well beyond the distance a door could be moved by rattling but is less than the thickness of the door which precludes the insertion of a crowbar so it represents an ideal choice.

Note that although the preferred embodiment of the present invention employs a spring within the armature mounting bolt to bias the moving plunger within the armature bolt towards assisting reclosure of the door, the utility of this aspect of the invention is not dependent on the presence of the spring but rather on the ability of the plunger to move a substantial distance within the armature bolt. In an alternate embodiment, the spring could be deleted because commercial doors of the type that receive delayed exit locking systems almost invariably include a door closer which externally replicates the functions of the spring.

The present invention also includes a novel sensor system for detecting movement of the door to its activation position. The sensor system includes a permanent magnet mounted to the door, and a triad of magnetically activated reed switches mounted to the door frame. When the door is in its fully closed position, the permanent magnet activates ("energizes") the first two reed switches, which are redundantly connected in case either switch fails. Movement of the door to the delay initiating position de-activates the two reed switches. This signals a system controller that someone is attempting to exit. The first two reed switches by themselves could be tampered with by placing a large permanent magnet into proximity with these switches, which would fool the reed switches into sensing a magnetic field even though the door had been moved to its activation position. To prevent this, a third tamper detection reed switch is added to the system. This tamper detection reed switch is not activated (not "energized") by the permanent magnet mounted to the door, but will be activated by the presence of a second permanent magnet introduced for tampering purposes. Thus, the system automatically detects when someone brings a second permanent magnet into proximity with the sensor in an attempt to tamper with it. In the present invention, such tampering immediately initiates delayed exit which preserves the safety function of the door as well as sounding an alarm.

It should be understood that the part of the present invention which prevents tampering can be separated from the previously described part which permits extensive door movement prior to initiating the exit delay sequence. In certain applications, tampering is not an important concern and the removal of the anti-tampering parts from the invention results in a much lower cost and less physically obtrusive system to be mounted on the door.

In one aspect, the present invention includes a door equipped with an armature for locking engagement with an electromagnet mounted to a door frame; an armature mounting bolt mounted within a hole in the door; a spring mounted within the armature mounting bolt for providing a bias that draws the armature to the door and urges the door to its fully closed position; a detent within the armature mounting bolt for allowing a predetermined limited movement of the door in a direction against the spring bias; a sensor mounted to the door frame for sensing when the door has been urged by an external force away from its fully closed position to an activation position; a controller for determining when the door has been urged to the activation position for at least a nuisance delay period and providing an alarm signal in response thereto, and thereafter counting an egress time period, and de-energizing the electromagnet at the end of the egress time period; at which point the person who has initiated the process may exit the door.

In another aspect, the armature mounting bolt of the present invention includes: a hollow shaft having a flanged end or head abutting the outside surface of the door, and having an opposite open end; a plunger within the shaft that is capable of moving in a direction coaxial with the shaft, the plunger head being positioned adjacent the shaft flanged end; a spring within the shaft, the spring engaging a lip within the shaft and further engaging the plunger head such that the plunger is biased away from the open shaft end and toward the flanged first end, the lip defining a detent; and a fastener for fastening the armature to the plunger back end. The plunger back end is threaded for engaging the fastener. The shaft is positioned within a hole in the door, and the plunger therefore defines a member that engages the armature and is movable within the volume defined by the door thickness. A threaded cap engages corresponding threads on the back of the shaft, thus retaining the spring and plunger within the shaft. The cap has a hole in it, such that the plunger can move forward and backward while being retained within the shaft.

The above-described objects of the present invention and other features and benefits of the present invention will become clear to those skilled in the art when read in conjunction with the following detailed description of a preferred illustrative embodiment and viewed in conjunction with the attached drawings and appended claims.

BRIEF DESCRIPTION OF THE DRAWINGS

FIG. 1 is a view of a delayed exit door equipped with a first preferred embodiment of the present invention.

FIG. 2 is an exploded view showing major components of the first preferred embodiment of the present invention shown in FIG. 1.

FIG. 9 illustrates a delayed exit door equipped with a second preferred embodiment of the present invention.

FIG. 10 is an exploded view showing major components of the second preferred embodiment of the present invention shown in FIG. 9.

FIG. 20 is a side view and FIG. 21 is a top view.

DETAILED DESCRIPTION OF THE PREFERRED EMBODIMENTS

Figure 3:
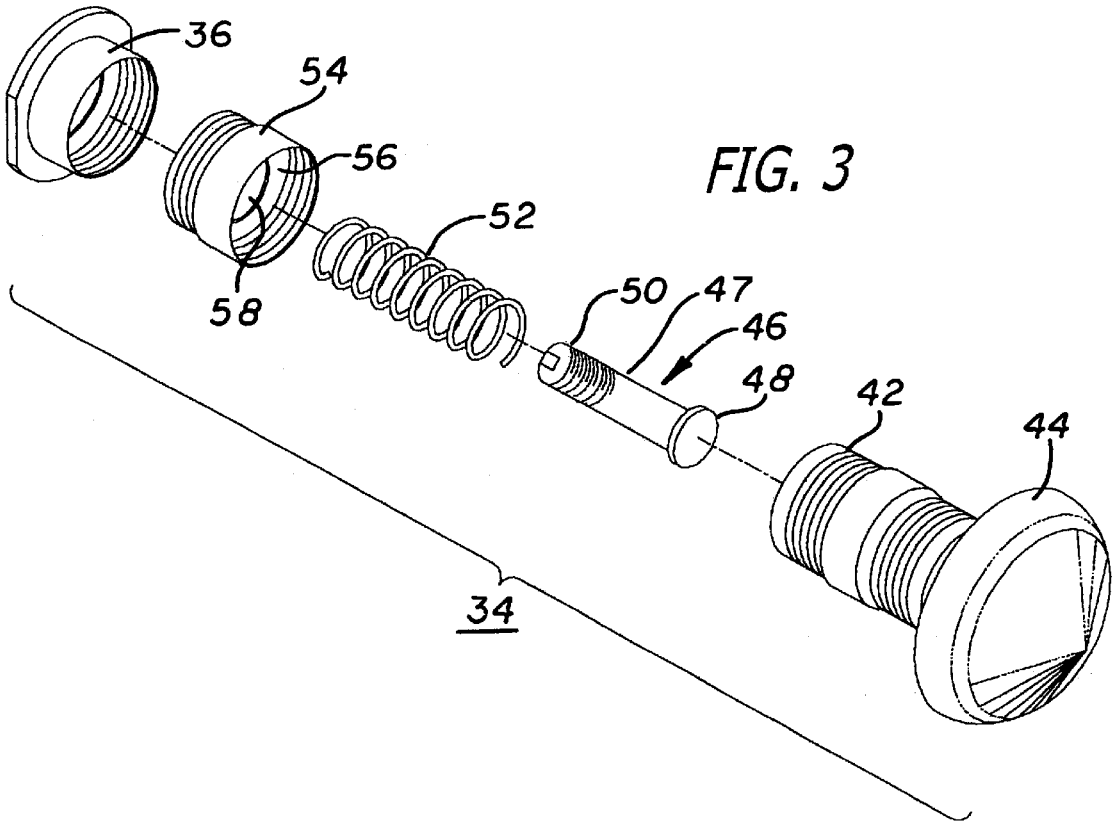
FIG. 3 is an exploded view of the spring biased armature mounting bolt of the present invention.

In accordance with a preferred embodiment of the present invention, FIG. 1 shows a typical emergency delayed exit door system. Door 10 is equipped with a panic bar 12 that operates a latch (not shown), the latch engaging a corresponding recess in door frame 14. Note that the latch could also be operated by a door knob or door lever set. Mounted to door frame 14 is an electromagnet assembly 16 including electromagnet 18. Door 10 is provided with an armature plate 20 for electromagnetically locking to electromagnet 18. To exit, a person presses on panic bar 12 and pushes the door outward for at least the nuisance delay period. The door will then be available for egress following the expiration of the typically 15 or 30 second egress delay period.

Figure 4:
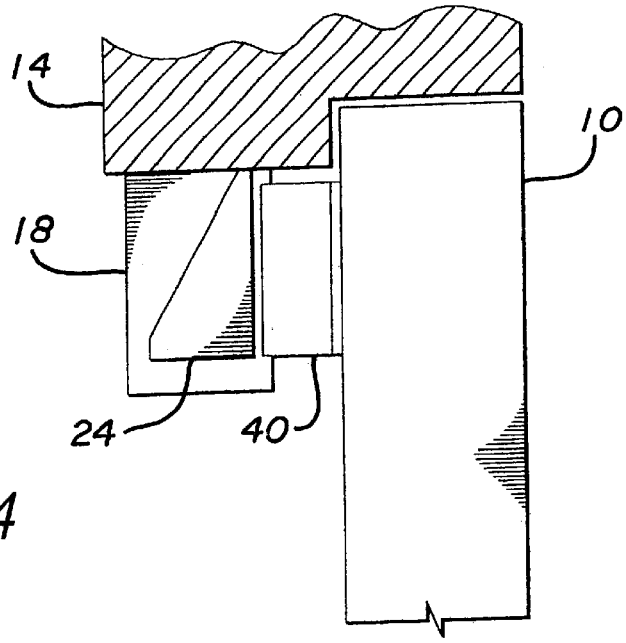
FIG. 4 is a side elevation view of a door equipped with the system of the present invention when the door is in its fully closed position.

FIG. 2 shows major components of the system in greater detail. Electromagnet assembly 16 includes electromagnet 18 typically containing "E" shaped electromagnet elements, and sensor assembly 24 containing a triad of magnetic reed switches. Electrical wires 25 serving sensor assembly 24 and electromagnet 18 feed up through the door frame header, and are not exposed. Assembly 16 includes a cover 26. Electromagnet armature 28 having two alignment pins 30 is fastened via fastener 32 to armature mounting bolt 34. The shaft of armature mounting bolt 34 is fitted through a corresponding hole in door 10 (FIG. 1), and is secured thereto by a post-installation cap 36 which forms part of armature mounting bolt 34. Typically, two or more flexible washers 38 allow armature 28 to pivot slightly relative to door 10 such that armature 28 can abut electromagnet 18 in full contact with it for maximum locking hold force. Permanent magnet 40 is also mounted to door 10 such that when door 10 is in its fully closed position, permanent magnet 40 is brought into sufficient proximity with sensor assembly 24 (FIG. 4) so that sensor assembly 24 detects that the door is fully closed. Controller 80 is connected to sensor assembly 24 and electromagnet 18 by electrical wires 25, and is also connected to alarm 82.

FIG. 3 is an exploded view of armature mounting bolt 34. A hollow shaft 42 threadably engages head 44 which abuts the outer surface 11 of door 10 (FIG. 5) when installed. Head 44 is typically made of hardened steel to repel hacksaw or similar attacks on the security of door 10 from outside. A plunger 46 within shaft 42 includes a plunger rod 47, a head 48 at one end of rod 47 relatively positioned adjacent the armature mounting bolt head 44, and threaded end 50 opposite plunger head 48. Threaded end 50 engages fastener 32 (FIG. 2) to hold armature 28 to plunger 46. Plunger rod 47 fits within spring 52. A seal cap 54 having lip 56 threadably engages shaft 42 to retain spring 52 and plunger 46 within shaft 42. This method of construction of armature bolt 34 permits changing the spring in applications where use is so heavy that failure of the spring could be a concern. Alternately seal cap 54 can be made a permanent part of shaft 42 which reduces the cost of armature bolt 34 but does not permit changing the spring. In either case, lip 56 acts as a detent to limit outward movement of plunger 46. Hole 58 in seal cap 54 has a large enough diameter to allow plunger rod 47 to pass therethrough. One end of spring 52 engages plunger head 48, while the other end of spring 52 engages lip 56.

Figure 5:
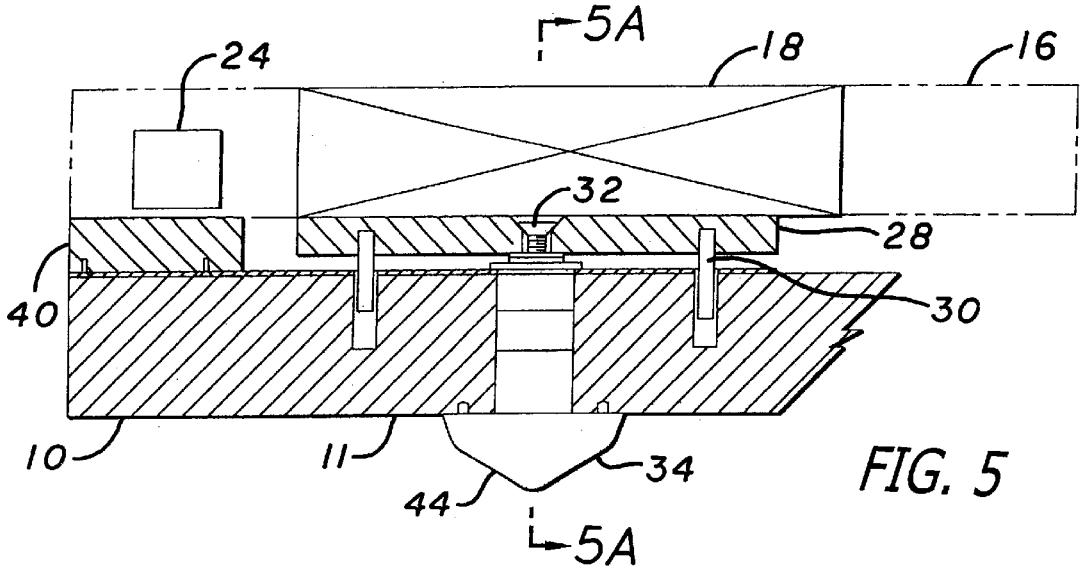
FIG. 5 is a top sectional view of the system of the present invention when the door is in its fully closed position.
Figure 5A:
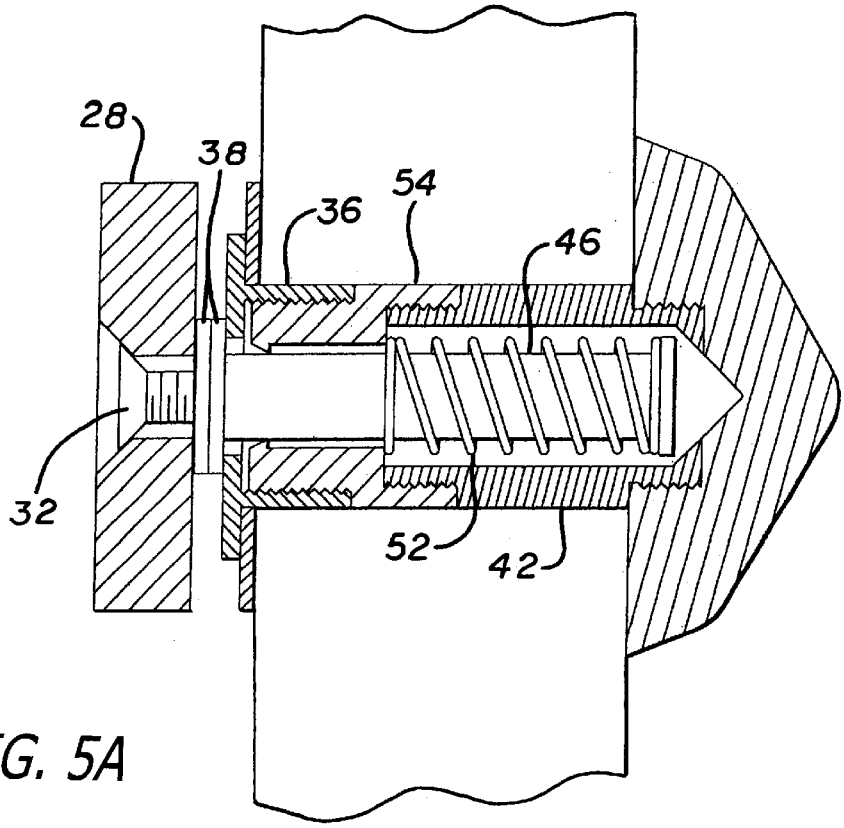
FIG. 5A is a sectional view showing additional details of the armature mounting bolt of FIG. 5.

FIG. 5 shows the electromagnetic lock installed in a door and door frame, with the door in its fully closed position. Armature 28 abuts electromagnet 18, and is electromagnetically locked to it. As shown in detail in FIG. 5A, spring 52 defines a resilient member that biases plunger 46 into shaft 42. This draws armature 28 against door 10, thus providing a bias means mounted within a volume defined by door 10 for providing a bias that urges the door toward its fully closed position. Permanent magnet 40 is sufficiently proximate to sensor assembly 24 to activate two of the three reed switches therein, thus signaling to system controller 80 (FIG. 2) that the door is in its fully closed position.

Figure 6:
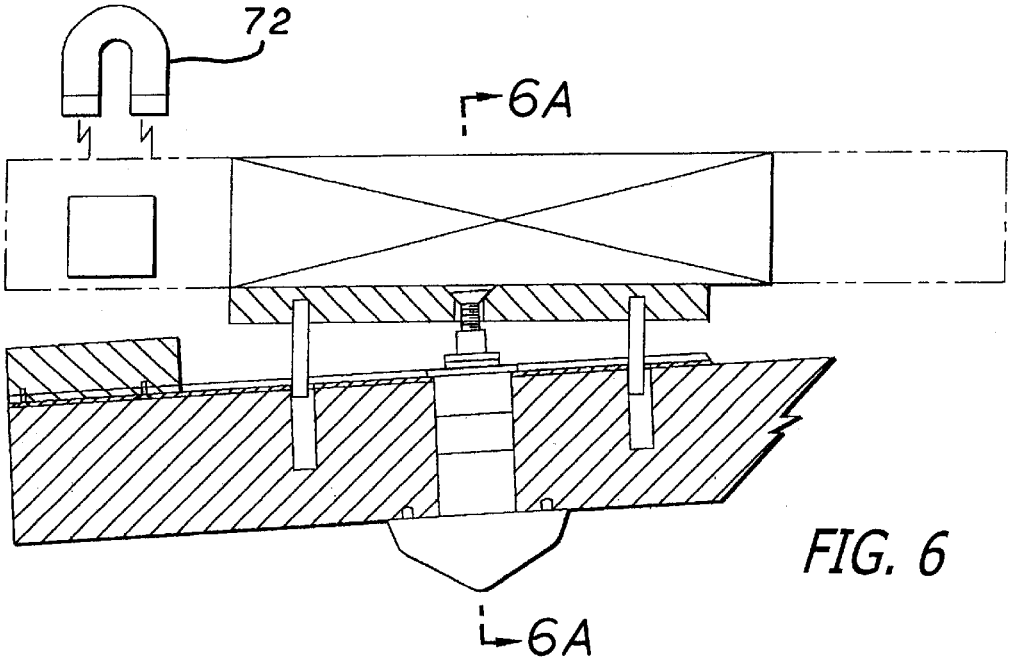
FIG. 6 is a top sectional view of the system of the present invention when the door has been moved to its activation position.
Figure 6A:
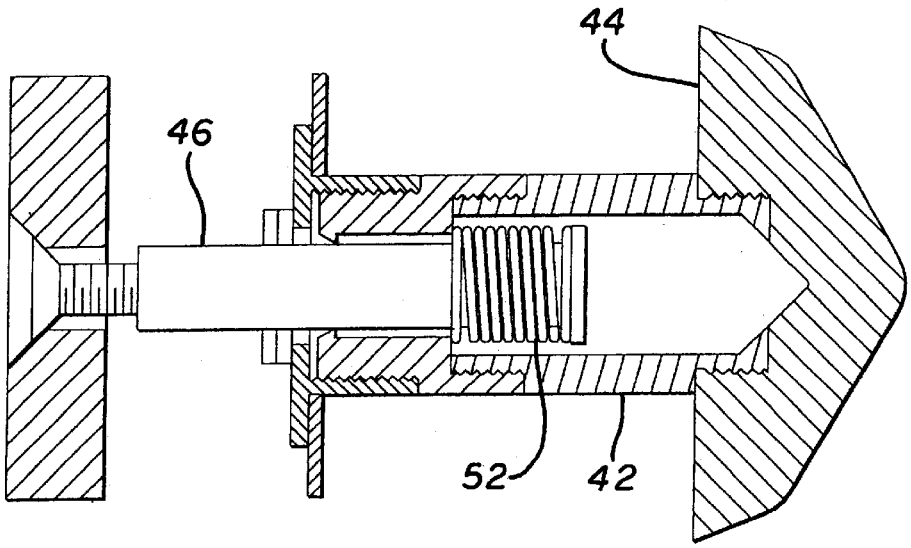
FIG. 6A is a sectional view showing additional details of the armature mounting bolt of FIG. 6.

FIG. 6 shows the components of FIG. 5 when someone is attempting to exit the building. The person first pushes panic bar 12 (FIG. 1) or similar door activating device to release the latch. The person is then able to push the door away from its fully closed position to the activation position shown in FIG. 6. To do so, the person must supply sufficient external force to overcome the bias provided by spring 52. Spring 52 must therefore be chosen to provide a small enough force so that even a small or frail person can push the door to the activation position. At the same time, the spring should provide enough bias so that when the door is pushed momentarily and then released, as for example by a vandal, the door will tend to overcome the resistance of the latch mechanism and return the door to its fully closed position. Accordingly, spring 52 is chosen to provide a bias force in the range of approximately 1 to 50 pounds, and preferably approximately 15 pounds. The spring can be pre-biased to provide a more constant bias force over the travel distance of plunger 46. Of course, the preferred force may be affected by development of building codes, as those codes develop with respect to systems such as that disclosed herein by themselves or in combination with other mechanisms attached to the door which may provide additional bias force. For example, the door may be equipped with a conventional door closer, and building codes may be passed that specify the maximum total force necessary to overcome the combination of mechanisms and open the door. In such a case, the spring must be chosen so as not to exceed such a maximum when combined with the door closer.

As shown in FIG. 6, the external force applied to the door by a person wishing to exit causes plunger 46 to be drawn outward from shaft 42, thus compressing spring 52. Since shaft 42 is positioned within the hole in door 10, as the door is moved plunger 46 moves within the volume defined by door 10 in a direction corresponding to the thickness of the door. As used herein, the phrase "within" the door will be understood to mean "at least partially within" the door. Plunger 46 is free to move a distance at least half the thickness of the door. If maximum possible travel distance is desired, armature mounting bolt head 44 could be formed such that plunger 46 extends into head 44 when the system is in its unforced state. In theory, this would allow plunger 46 to move a distance as much as or even more than the width of door 10. By allowing the plunger to move within the volume defined by the door thickness, the present invention achieves a much greater movement distance than could be achieved with prior art systems. These prior art systems provided only limited movement of the door, since slack was provided only within the armature plate. Since typical armature plates are on the order of one-half inch (1.27 cm), allowed lineal movement was small. In contrast, a typical security door is on the order of 1 ¾ inch (3.4 cm) thick. The present system therefore allows travel distances of at least 1, 2, or even 3 or more cm. There are several advantages to this greater travel distance. The first is that the activation distance can be set far enough such that rattling within the space of the usual slack in the latch will not cause a false initiation of the system.

A second advantage is that it provides greater tactile and visual feedback to the person attempting to make an emergency exit. This provides greater assurance to a possibly panic-stricken individual that the door is functioning properly and will release shortly. A third advantage is that with a greater travel distance, the sensors that sense when someone is attempting to exit need not be as precise in their ability to measure that the door has been moved a specified amount. This allows sensors to be more economical, more tamper-resistant, and/or easier to install and maintain.

Figure 7:
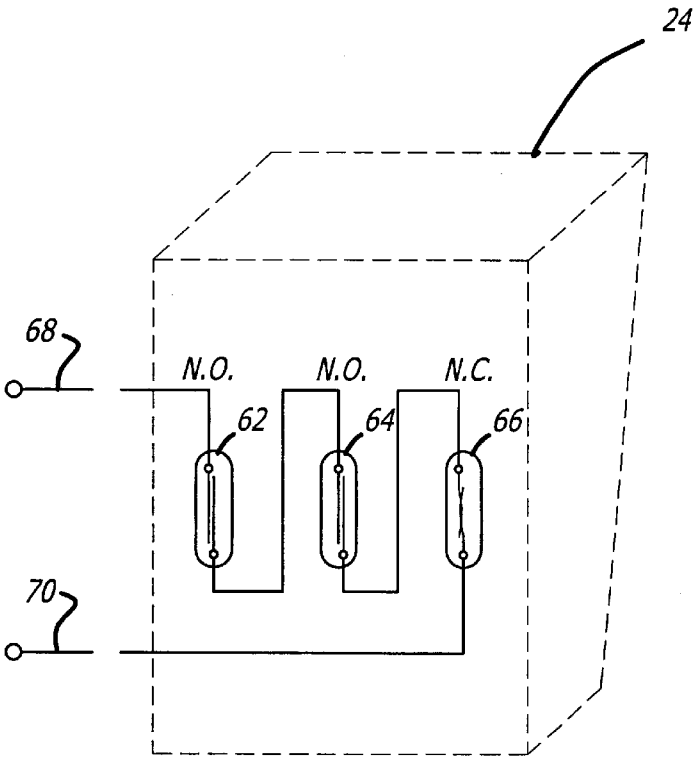
FIG. 7 is a schematic representation of the reed switches within the sensor assembly 24 of FIG. 1.

For example, the present system includes a sensor assembly 24 comprising a triad of magnetic reed switches as shown in FIG. 7 to sense when the door has been moved in an attempt to exit the building. Two reed switches 62 and 64 designated "delay initiating reed switches" sense the presence of permanent magnet 40 in the fully closed door position. When door 10 is moved from the fully closed position, switches 62 and 64 change state by becoming deenergized. This defines the door "activation position" (FIG. 6). In the embodiment shown in FIG. 7, the delay initiating reed switches are of the normally open configuration. The presence of permanent magnet 40 causes the switch contacts to close. First and second delay initiating reed switches 62 and 64 are electrically connected in a redundant manner so that even if one fails to properly signal that permanent magnet 40 has been moved away, a delay initiating signal will be generated nevertheless. In the configuration shown, even if one delay initiating switch fails such that its contacts become stuck in the closed position, the other switch will open up such that the controller sees an open circuit across terminals 68 and 70. If the open circuit condition (the "delay initiating signal") persists for more than the nuisance delay, the system controller begins an egress delay countdown, at the end of which the controller issues a door unlock signal that causes electromagnet 18 to be de-energized. It will be noted that the magnetic field created by electromagnet 18 is sufficiently confined and directed such that the field does not affect the operation of the sensors within sensor assembly 24.

Without an aspect of the present invention, it would be possible to tamper with the system by bringing a large permanent magnet 72 such as shown in FIG. 6 into proximity with sensor assembly 24. While a casual vandal would be unlikely to know that magnetic sensors are positioned underneath cover 26 and how to defeat them, a security guard or someone else familiar with security systems is likely to have such knowledge. Magnet 72 introduced by such a person would cause the contacts of delay initiating reed switches 62 and 64 to close and stay closed, even after someone attempting to exit had pushed the door to its activation position. This would prevent the door from ever opening, which could result in a person being trapped. To prevent this situation, a third reed switch 66 is provided. This reed switch detects the presence of tampering. Tamper-detect reed switch 66 is of the normally closed configuration.

Permanent magnet 40 mounted to door 10 is insufficient to cause the contacts of switch 66 to open. Thus, when the door is in its fully closed position, all the contacts of switches 62, 64, and 66 are closed. However, if someone attempts to tamper with the system by introducing magnet 72, the contacts of reed switch 66 will open, thus sending an initiate signal to the controller. The activation gauss levels of the switches, and the position of the switches, are chosen such that an external magnet 72 will cause the contacts of tamper-detection reed switch 66 to open before the contacts of delay initiating reed switches 62 and 64 close. Thus, an attempt to tamper with the system will cause alarm 82 to sound, and the egress delay to be initiated. The sensor assembly is therefore highly immune to tampering of the type that plagues systems currently in use. It will be observed that although the embodiment shown uses two normally open activation switches and one normally closed tamper detection switch all connected in series, one could substitute instead two normally closed activation switches and one normally open tamper detection switch all connected in parallel. The embodiment shown is preferred, because cutting of either of the two wires that exit sensor assembly 24 by someone attempting to defeat the system will create an open circuit or activation condition, thus immediately sounding the alarm.

Figure 8:
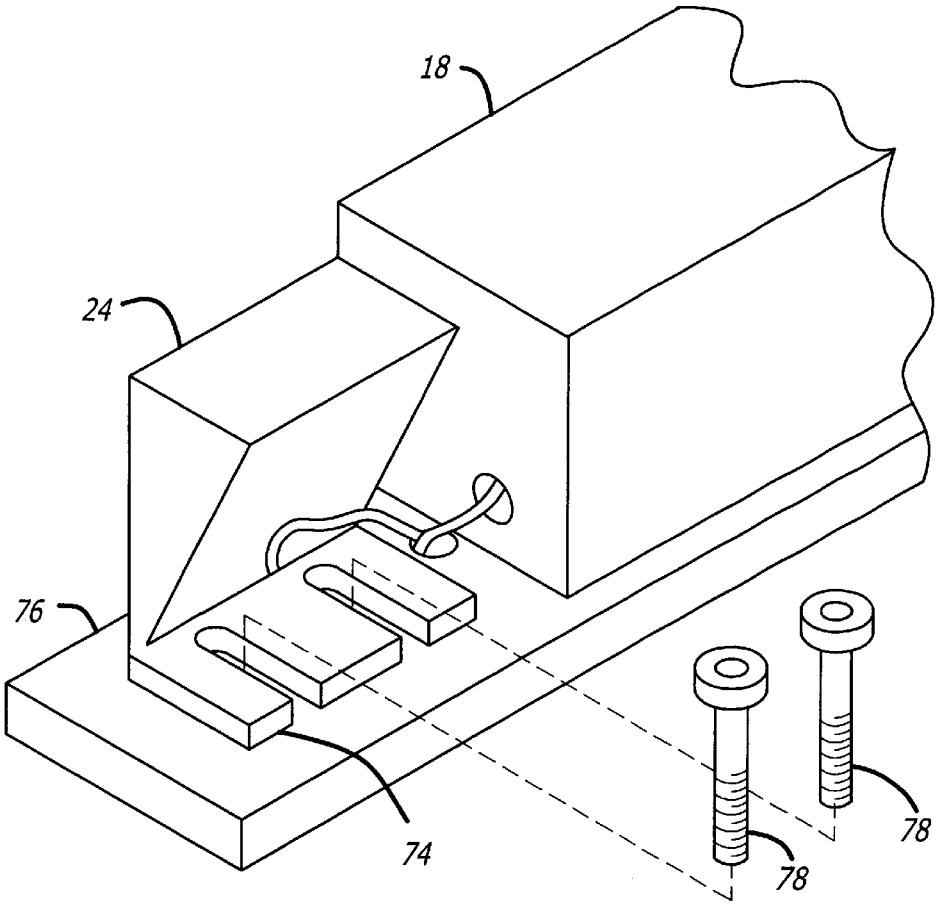
FIG. 8 is a perspective view of the sensor assembly 24 of FIG. 1 shown mounted on an adjustable frame.

In a preferred embodiment shown in FIG. 8, reed switches 62, 64, and 66 are potted and mounted on a frame 74, the frame being secured to base 76 of electromagnet assembly 16 by securing screws 78. By loosening securing screws 78, the system installer can easily slide sensor assembly 24 back and forth, then secure the assembly in its new position. This allows the installer to easily adjust the amount of movement permitted to the door prior to the delay initiating. This permits, for example, accommodation to differing amounts of free movement in the door latching hardware.

FIGS. 9 and 10 show an alternate embodiment of the present invention for applications where the threat of tampering is not significant and where low cost is important. By relaxing the anti-tampering requirement, many components can be eliminated from the preferred embodiment.

FIGS. 9 and 10 are variations on FIGS. 1 and 2, and are presented to make the reduction of components in the alternate embodiment clear. In the alternate embodiment, the costly and relatively complex sensor assembly 24 and permanent magnet 40 are respectively replaced by small and inexpensive cylindrical permanent magnet 84 and reed switch 86. The permanent magnet 84 is fitted into a hole drilled in the top of the door as shown and the reed switch 86 is fitted into a hole drilled into the door header 88. The combination of permanent magnet 84 and reed switch 86 are widely sold as pairs called "door switches" or "magnetic contacts" from companies such as Sentrol, C&K and Ademco. The use of this separately mounted door position sensor eliminates as well the requirement for cover 26 whose function was to protect sensor assembly 24 from tampering. Without cover 26, there is no need for an electromagnet assembly plate. Instead, the electromagnet 18 mounts directly onto door header 88. The reduction in number of components in the alternate embodiment not only reduces system cost but presents a much less obtrusive appearance on the door which is important to certain customers. The function of the system is the same as in the preferred embodiment except that it is relatively easy for a building guard to defeat the egress initiating signal from the reed switch 86 by affixing a permanent magnet adjacent to it so that reed switch 86 will not change state as the door begins to open.

It will be observed that a distinct advantage of the present invention over certain prior art systems is that it allows existing doors equipped with panic bars to be retrofitted to allow for delayed exit, without the need to replace the existing push bar or other latching hardware. With prior art systems that employed a switch located within the push bar, replacing the existing push bar with one that included a switch was necessary. It will also be observed that various types of positive feedback can be provided to inform the person attempting to exit of the time remaining before release, such as a visual countdown indicator or a voice synthesizer as disclosed in U.S. Pat. No. 5,429,399 issued to Geringer et al. It will further be appreciated that the controller function can be provided by a variety of mechanisms including a mechanical controller, hardwired electronic logic, a microprocessor or microcontroller, or some intermediate type of electronic controller such as a sequential circuit programmable logic device (PLD).

Figures 11, 12, 13:
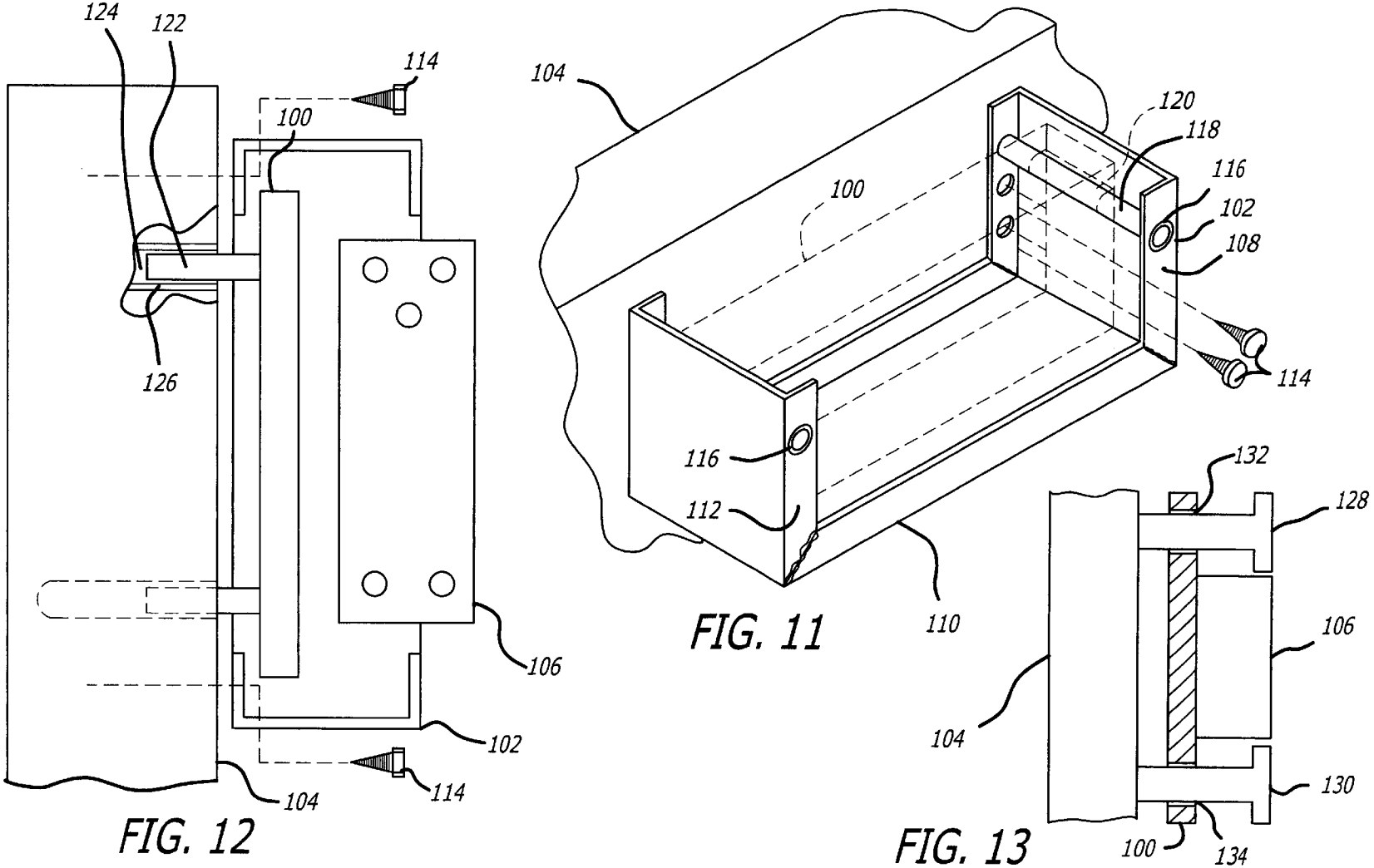
FIG. 11 is a perspective view of an armature mount in an embodiment of the invention.
FIG. 12 is an exploded top view of an armature mount similar to that shown in FIG. 11, but could also be a side view in another embodiment.
FIG. 13 is a top view, partially in section, of an armature mount in an embodiment of the invention, but could also be a side view in another embodiment.

With reference to FIGS. 11 and 12, in another embodiment the mounting of the armature 100 is effected by a bracket 102 which contains the armature but allows movement toward and away from the door 104. As can be appreciated, the bracket is generally U-shaped and fits over an electromagnet 106 mounted to a door frame (not shown). As the door closes the armature and the electromagnet make contact and the bracket continues past the electromagnet so that the electromagnet is received at least partially within the bracket. As the door is opened, the armature, which is held against the electromagnet, prevents the bracket from moving past, catching on inwardly extending flanges 108, 110, 112 at the front of the bracket 102.

The bracket 102 is attached to the door 104 by fasteners 114. In one embodiment elongated attaching fasteners 116 are provided having a long shank 118 which extends through the bracket 102, and cooperates with a slot 120 or hole (not shown) in the armature to stabilize the armature within the bracket. It will be understood that if the bracket and armature are sized relative to one another so that the armature cannot turn excessively within the bracket that no stabilization is needed. However, if the bracket is made quite deep, allowing considerable opening movement of the door while the electromagnet 106 holds the armature 100, some provision for stabilizing the armature within the bracket will be required. In another example of such a stabilization arrangement, in FIG. 12 the armature is shown having a bar 122 extending into a hole 124 formed in the door or a sleeve 126 fitted in the door.

With reference to FIG. 13, in another embodiment the armature 100 rides on headed pins 128, 130 extending from the door 104. Holes 132, 134 in the armature receive the headed pins, which are attached to the door by a threaded connection or by welding or another secure means. When the door closes the pins extend inwardly on either side of the electromagnet 106, the distance between the pins being great enough to allow them to swing past the electromagnet along an arc, but close enough that the armature is not subject to large bending forces if the door is opened with considerable force, for example by kicking the door. In one embodiment a headed pin closest to the hinge side of the door can be slightly shorter than the other headed pin, so that as the door is opened along an arcing path, the two headed bolts 128, 130 contact the armature 100 at the same time.

Figure 14:
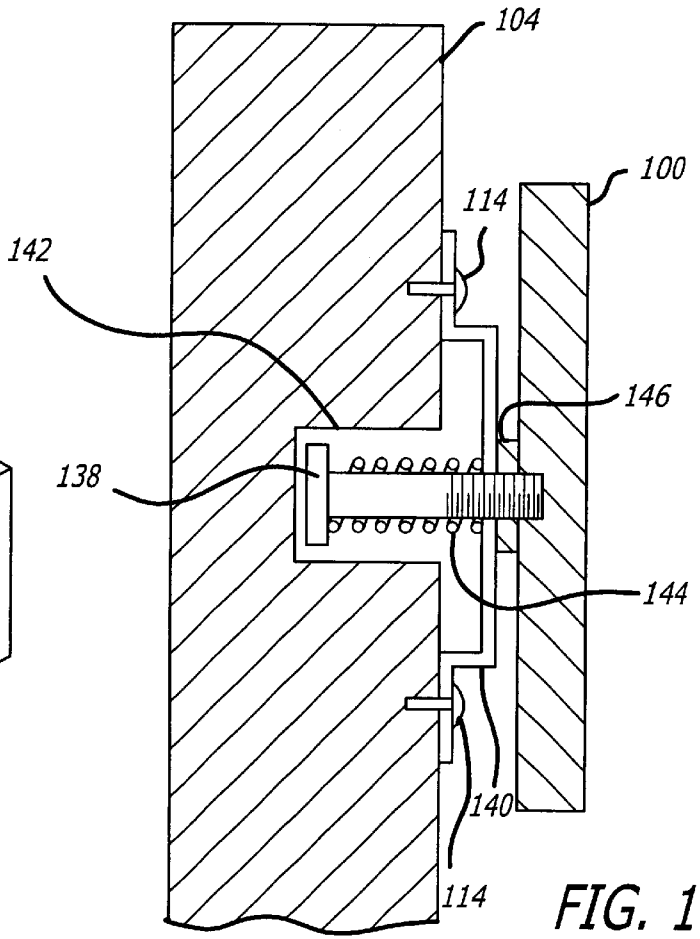
FIG. 14 is a sectional view of an armature mount in an embodiment of the invention.
Figure 15:
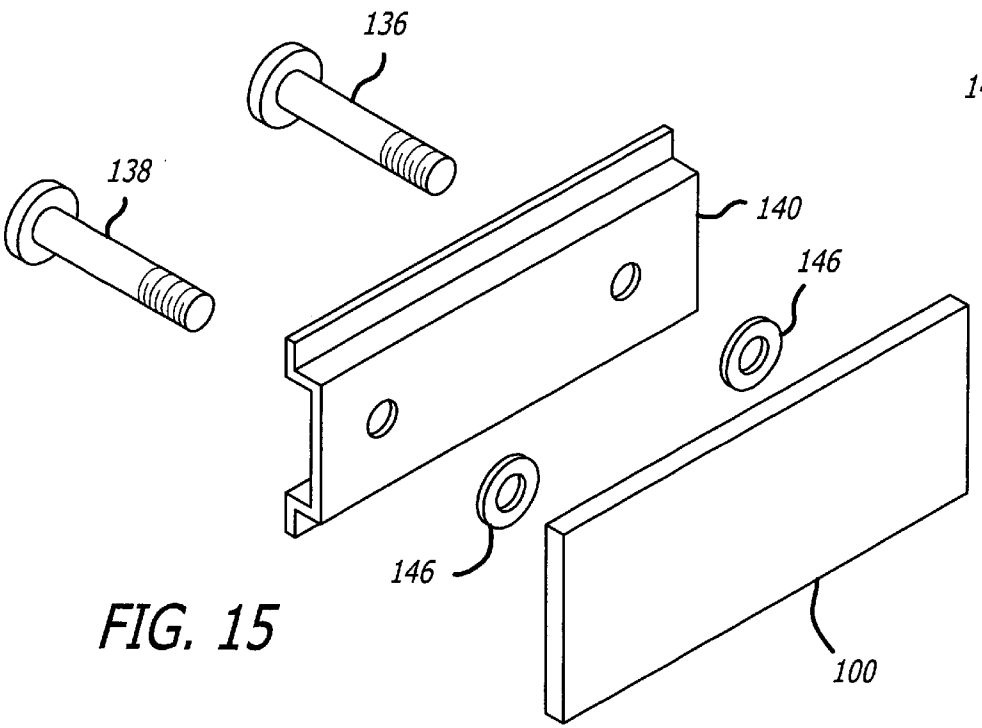
FIG. 15 is an exploded perspective view of the armature mount of FIG. 14.

With reference now to FIGS. 14 and 15, in another embodiment the mounting of the armature 100 is by means of two armature mounting bolts 136, 138 and a mounting plate 140. The mounting plate is attached to a door 104 by fasteners 114, and recesses 142 are provided in the door to accommodate the length of the armature mounting bolts. The mounting plate, armature mounting bolts and recesses cooperate to provide considerable movement of the armature relative to the door. This allows opening the door 104 by this same amount while the armature 100 is still held against the electromagnet (106 in FIG. 12). Optionally, a spring 144 and washers 146 can also be provided. The washers can be replaced by threaded locking nuts (not shown) which cooperate with the armature mounting bolts 136, 138 and armature to prevent loosening of the armature mounting bolts. The optional spring acts to pull the door and the armature together.

Figure 16:
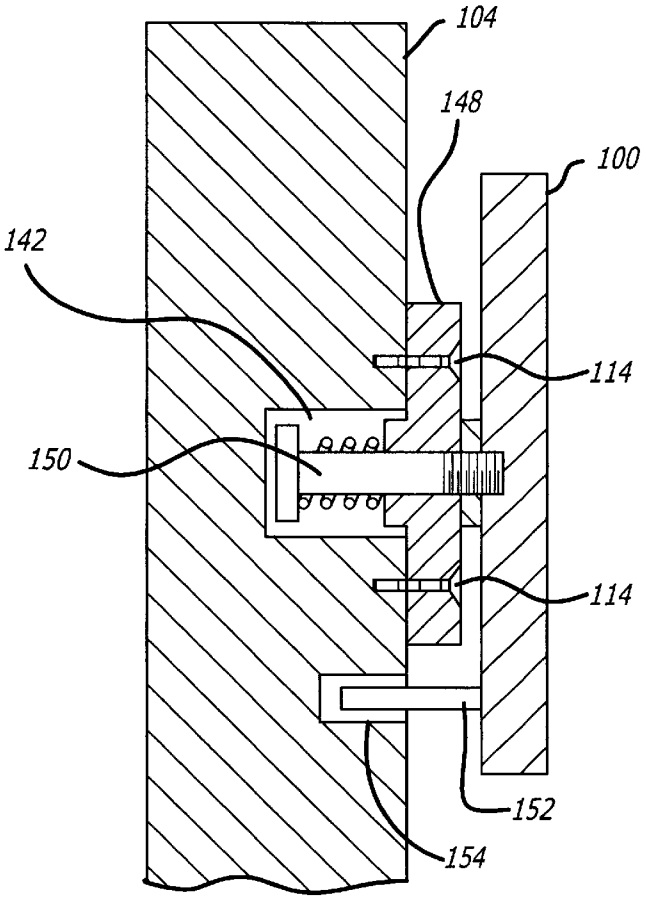
FIG. 16 is a sectional view of an armature mount in an embodiment of the invention, and could be a top view in one embodiment or a side view in another embodiment.

Turning now to FIG. 16, in another embodiment mounting of the armature 100 is accomplished by a slightly different structure wherein a flanged sleeve 148 supports a armature mounting bolt 150, and thereby the armature. The flanged sleeve is attached to the door by fasteners 114 over a recess 142 in the door 104 accommodating the length of the armature mounting bolt within the door. A pin 152 cooperates with a hole 154 in the door to keep the armature from rotating. Alternatively two armature mounting bolts can be provided in a manner similar to that illustrated in FIG. 15. With reference again to FIG. 16, an optional spring 144 can be provided, but is not necessary.

Figure 17:
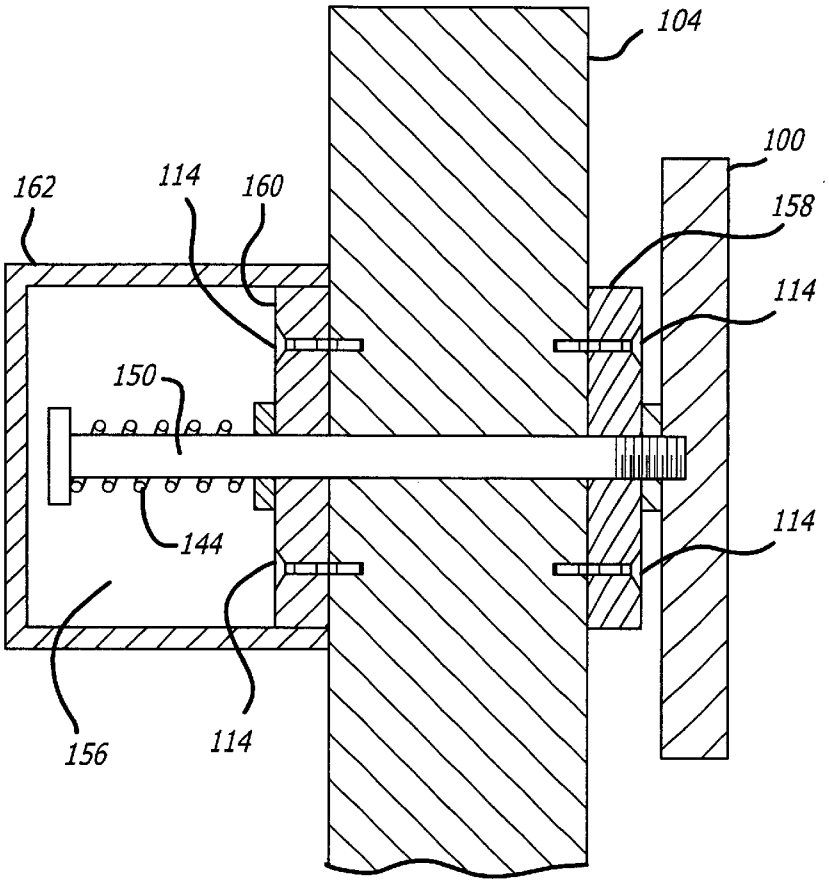
FIG. 17 is a sectional view of an armature mount in an embodiment of the invention, and could be a top view in one embodiment or a side view in another embodiment.

With reference to FIG. 17, in another embodiment a similar structure in appearance is provided on the inside of the door 104, but instead of providing a recess in the door for the armature mounting bolt 150, a covered enclosure 156 is provided on the outside of the door to accommodate movement of the armature mounting bolt with respect to the door. Plates 158, 160 are provided on each side of the door. A cover 162 is attached to the outer plate 160 by a tamper-resistant means such as pinning or welding to protect the armature mounting bolt. A spring 144 for biasing the armature 100 toward the door 104 can be provided if desired, but is not necessary. The armature is prevented from rotating around the armature mounting bolt by providing a pin arrangement such as that shown in FIG. 16, or by using two armature mounting bolts as previously described.

Figure 19:
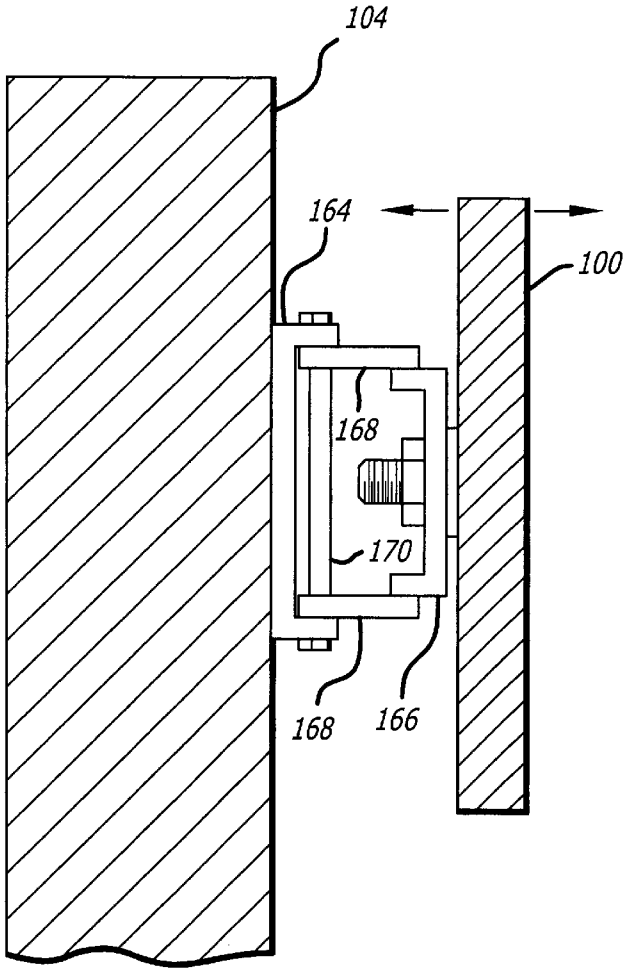
FIG. 19 is a side view of the armature mount of FIG. 18, however, in another embodiment FIG. 18 can be a side view and FIG. 19 a top view.
Figure 18:
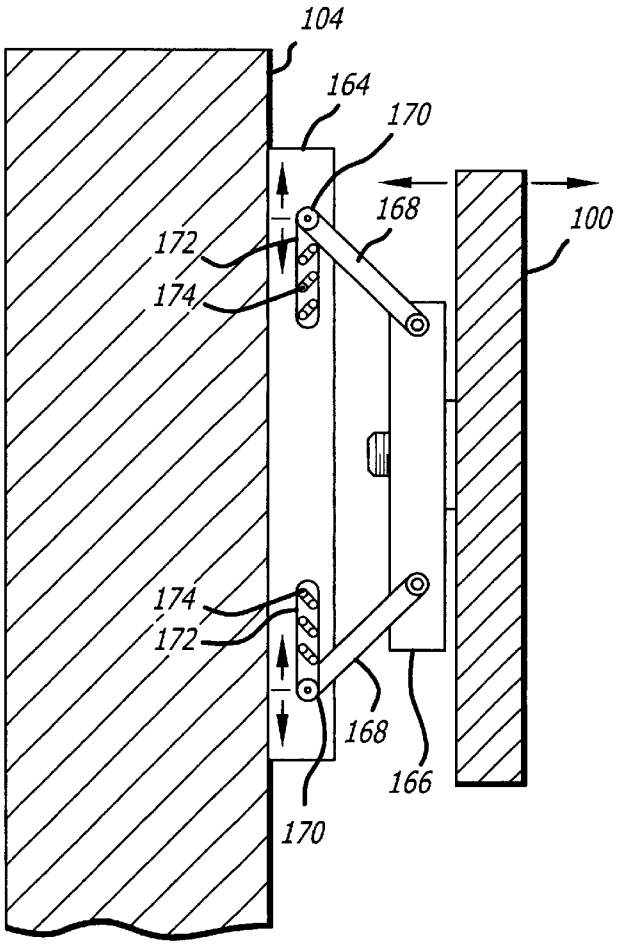
FIG. 18 is a top view of an armature mount in an embodiment of the invention.

With reference now to FIGS. 18 and 19, in another embodiment mounting of the armature 100 to the door 104 is accomplished by another means allowing relative movement therebetween. A stationary bracket 164 is attached to the door by fasteners (not shown), welding, or another known secure means. The stationary bracket is attached to a moving bracket 166 by swing arms 168 and pins 170. The moving bracket carries the armature. The pins are held in slots 172 formed in the stationary bracket. As the armature moves towards and away from the door, the pins move in the slots in a transverse direction toward and away from each other. The amount of relative movement is governed by the lengths of the swing arms and of the slots. In one embodiment an optional spring 174, or multiple springs, can be provided to bias the pins apart, and thereby bias the armature toward the door.

Figure 21:
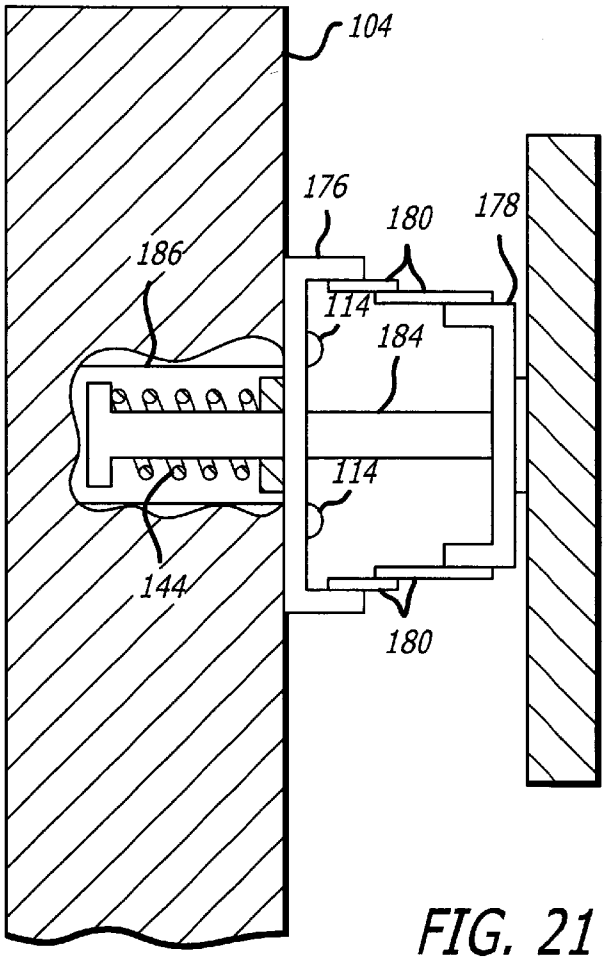
FIG. 21 is a side view of the armature mount of FIG. 20, however in another embodiment
Figure 20:
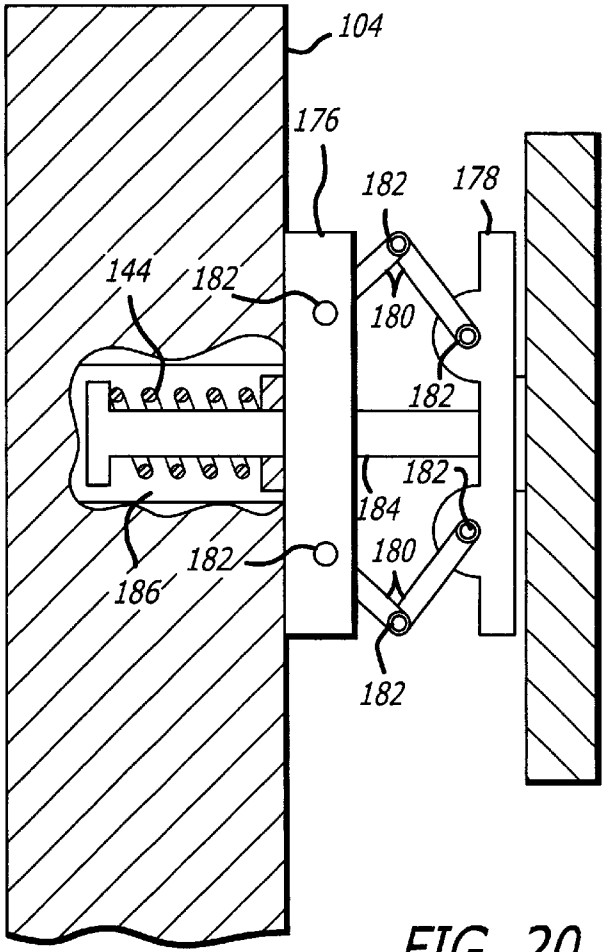
FIG. 20 is a top view of an armature mount in an embodiment of the invention.

A variation of this arrangement is shown in FIGS. 20 and 21. A stationary bracket 176 is attached to a door 104 in a secure fashion, for example by fasteners 114. A moving bracket 178 carries the armature 100 and is attached to the stationary bracket by accordion-folding swing arms 180 connected by pins 182. As will be appreciated, by lengthening the swing arms considerable travel of the armature with respect to the door is enabled. In a further variation, an optional armature mounting bolt 184 can be provided. While FIG. 20 is a top view and FIG. 21 a side view, these views can be reversed if the armature mounting bolt is included to stabilize the armature. Furthermore, a recess 186 is provided in the door to accommodate the armature mounting bolt, if one is used. An optional spring 144 can be provided to bias the armature toward the door.

As can be appreciated, numerous ways to attach the armature 100 to the door 104 can be used, the common feature being that the armature is free to move away from the door. It will be apparent that some of the mounting means described above allow movement greater than the thickness of the door if that is desired. Further, a spring may be used to bias the armature towards the door, but a spring is not required in most cases for functionality of the mounting. For example a coil spring could be disposed over the shank 118 in the embodiment of FIG. 11, or over the headed pins 128 and 130 in the embodiment of FIG. 13, to bias the armature toward the door, but such springs are not needed for the mounting arrangement to function otherwise as intended.

Commonly owned copending U.S. patent application Ser. No. 08/831,069, of which this application is a continuation in part, is hereby incorporated by reference.

Although the present invention has thus been described in detail with regard to the preferred embodiments and drawings thereof, it should be apparent to those skilled in the art that various adaptations and modifications of the present invention may be accomplished without departing from the spirit and the scope of the invention. For example, although a spring is preferred for simplicity, a gas cylinder or other bias member could be mounted within the armature mounting bolt to perform the biasing function. Or, as has been stated earlier, the spring may be eliminated and the door closer which is invariably present on commercial doors will solely perform the function of closing the door. Additionally, the armature mounting bolt described herein can also be employed in systems which rely on door position sensors of other types than the magnetic reed switch arrangement disclosed herein. Accordingly, it is to be understood that the detailed description and the accompanying drawings as set forth hereinabove are not intended to limit the breadth of the present invention, which should be inferred only from the following claims and their appropriately construed legal equivalents.

What is claimed is:

1. An emergency exit door lock system configured to cooperate with a door mounted in a door frame, the system being configured for sensing when a person attempts to open said door, and for allowing said door to open after a subsequent delay, the system comprising:

a magnetic lock configured for preventing said door from opening, said lock including an electromagnet configured to be mounted on said door frame and an armature configured to be mounted on said door facing said electromagnet;

an inertia absorbing elastically deformable connection at least partially housed within said door and configured to mount said armature on said door, said connection allowing a predetermined limited movement of said door relative to said armature and biasing said armature and said door toward a first relative position adjacent one another, said connection including a plunger at least partially housed within said door, connected to the armature, and configured for extending into said door when the connection is mounted thereto and an elastic biasing member at least partially housed within said door configured for resisting relative movement between the plunger and said door in which said elastic biasing member is configured to be mounted, the connection allowing relative movement of said door and the armature against resistance provided by the elastic biasing member;

a sensor configured to be mounted to said door frame for sensing when said door has been urged by an external force away from said fully closed position to an activation position; and a controller coupled to said sensor, the controller being configured to provide an alarm signal in response to operation of said sensor sensing when said door has been moved away from said fully closed position to an activation position, and for providing a door unlock signal to de-energize said electromagnet at the end of a predetermined egress delay period.

2. The emergency exit door lock system of claim 1, wherein said elastic biasing member is configured for providing a bias force of 1 to 50 lbs. that urges said door towards said armature and to a fully closed position.

3. The emergency exit door lock system of claim 2, wherein said bias force is approximately equal to 15 pounds.

4. The emergency exit door lock system of claim 1, wherein said limited door movement is greater than 2 cm.

5. The emergency exit door lock system of claim 1, wherein said connection between said armature and said door is adapted to accommodate a thickness of said door up to a first thickness, and said limited door movement is greater than one half the first thickness of said door.

6. The emergency exit door lock system of claim 1, wherein said elastic biasing member is a spring.

7. The emergency exit door lock system of claim 1, wherein said armature is adapted to be mounted to said door by an armature mounting bolt, said armature mounting bolt comprising:

a hollow shaft configured to be fitted within a hole in said door, the shaft having a flanged first end and an open second end opposite said first end, the flanged first end abutting a first surface of said door;

said plunger configured to be positioned within said shaft and capable of moving in a direction coaxial with said shaft, said plunger having a head at a first end opposite a second end, the head being positioned adjacent the shaft flanged first end;

a coil spring configured to be disposed within the shaft, said coil spring comprising said elastic biasing member, the spring engaging a lip within the shaft and further engaging the plunger head such that the plunger is biased away form said open shaft end and toward the shaft flanged first end; and a fastener configured for fastening the armature to the plunger second end.

8. The emergency exit door lock system of claim 1, wherein the sensor comprises a door switch, the door switch comprising a first part which is configured to be mounted in said door and a second part which is configured to be mounted in said door frame, and wherein the second part will change electrical state when said door begins to open thereby causing a distance between the first and second parts to increase.

9. The emergency exit door lock system of claim 1, wherein the sensor comprises:

a first delay initiating reed switch configured to be mounted to said door frame, such that when said door is in its fully closed position said first delay initiating reed switch is energized by a permanent magnet, and when said door is in its activation position said reed switch is de-energized.

10. The emergency exit door lock system of claim 9, wherein the sensor further comprises a second delay initiating reed switch electrically connected redundantly with said first delay initiating reed switch.

11. The emergency exit door lock system of claim 10, wherein the sensor further comprises:

a tamper detection reed switch, said tamper detection reed switch not being energized by the first permanent magnet when said door is in its fully closed position.

12. The emergency exit door lock system of claim 11, wherein said reed switches are mounted to a frame that is slidable relative to said permanent magnet.

13. An electromagnetic door lock system configured for use with a door mounted in a door frame, the door having substantially parallel exterior and interior door surfaces defining a door volume therebetween, the door further having a hole therein extending from the interior door surface into the door volume, comprising:

an electromagnet configured to be affixed to the door frame for electromagnetically attracting an armature;

an armature mounting device further comprising:

a first member configured for being affixed to said door, said first member having an axis normal to said exterior and interior door surfaces, and said first member being disposed at least partially within said door volume through said door volume through said hole in the door when mounted therein;

a second member retained by said first member, said second member being configured so as to be moveable along said axis such that said second member moves within the door volume to allow opening movement of the door when the armature is held adjacent the electromagnet; and a bias member disposed within said first member configured for biasing said second member toward said exterior door surface;

an armature affixed to said second member configured to be adjacent said interior door surface;

a sensor configured to be mounted to the door frame for detecting movement of the door; and a controller configured for de-energizing the electromagnet at an egress time after the sensor senses said door movement, the first, second and bias members being configured to cooperate to allow opening movement of the door when the armature is held to the electromagnet.

14. A system in accordance with claim 13, wherein said second member is moveable at least 1 cm relative to said first member.

15. A system in accordance with claim 14, wherein said second member is moveable at least 2 cm relative to said first member.

16. A system in accordance with claim 13, wherein said bias member provides a bias force of about 1 to 50 pounds.

17. A system in accordance with claim 16, wherein said bias member is a coil spring, and said bias force is about 15 pounds.

18. A system in accordance with claim 13, wherein said second member comprises a plunger.

19. A system in accordance with claim 15, further comprising a first permanent magnet mounted to the door such that said first permanent magnet aligns adjacent with the sensor when said door is in a fully closed position, and wherein said sensor comprises a first reed switch.

20. A system in accordance with claim 19, wherein the sensor further comprises a second reed switch for detecting when a second permanent magnet is brought into proximity with said first reed switch, the second reed switch being not energized by said first permanent magnet when the door is in its fully closed position.

21. An electromagnetic door lock system for a door having interior and exterior faces and being mounted in a door frame, comprising:

an electromagnet configured to be mounted to the door frame;

an electromagnet armature mountable on the door and cooperating with the electromagnet to provide a locking action when the electromagnet is energized;

an electromagnet armature door mounting device configured for allowing predetermined limited outward movement of the door when said armature is held against said electromagnet, further comprising:

a hollow shaft adapted for mounting to a door in a position disposed within the door, the hollow shaft defining an opening adjacent an interior face of the door and an inwardly extending lip;

a plunger retained within the hollow shaft and configured to be engageable with the armature, said plunger having a head, and said plunger being configured to be moveable within a volume defined by the door when the device is mounted to the door in a direction normal to the interior face of the door, movement of the plunger with respect to the hollow shaft allowing the door to be moved outwardly a predetermined limited distance while said armature is held against said electromagnet, said inwardly extending lip and the head of the plunger acting to limit door movement;

a sensor configured for sensing opening of the door when the door is opened the predetermined limited distance.

22. The system of claim 21, further comprising a spring disposed between said inwardly extending lip and said head of the plunger.

23. The system of claim 21, wherein the sensor comprises a first permanent magnet and a first reed switch.

24. The system of claim 23, wherein the a first reed switch is configured to be mounted to the door frame such that when the door is closed the permanent magnet is brought sufficiently adjacent the first reed switch to energize said first reed switch, the first permanent magnet being located in a first direction relative to said first reed switch; and a second reed switch configured to be mounted to the door frame near the first reed switch, such that when the door is closed said permanent magnet does not energize the second reed switch, and such that a second permanent magnet having sufficient strength to energize said first reed switch from a direction other than said first direction will also energize said second reed switch; and a detector for detecting a tamper condition when said second reed switch is activated.

25. The system of claim 21, further comprising a timer connected to the sensor and configured for indicating elapse of a predetermined time period after opening of the door within the predetermined limited distance;

whereby the electromagnet can be de-energized upon indication from the timer after a predetermined time period after the door is opened within the predetermined limited distance.

26. An electronic door lock system for a door mounted in a door frame of the type where an electromagnet is mounted to the door frame and an electromagnet armature is mounted to the door, comprising:

an electromagnet;

an armature for cooperating with said electromagnet;

a sleeve having first and second ends and configured for mounting in a door between the interior and exterior surfaces of the door, the sleeve including an inwardly extending lip positioned adjacent the first end of the sleeve, said first end being configured to be positioned adjacent the interior surface of the door when the sleeve is mounted therein;

a plunger disposed in the sleeve, the plunger having a first end configured for connection to the electromagnet armature and a second end, and including a head adjacent the second end, the head and the lip cooperating to limit movement of the plunger relative to the sleeve; and the sleeve and plunger being configured for limited relevant movement, such that when the sleeve and plunger are mounted in a door with an electromagnet plunger attached to the plunger the plunger is moveable in a direction substantially normal to the interior face of the door, whereby the electromagnet armature door mounting device allows substantial opening movement of the door while the electromagnet armature is held against the electromagnet.

27. The system of claim 26, further comprising a spring disposed between the lip of the sleeve and the head of the plunger, the spring biasing the plunger towards the exterior surface of the door when the device is mounted to a door.

28. The system of claim 27 where the spring is a coil spring disposed about the plunger.

29. The system of claim 27, further comprising a sensor configured for sensing opening of the door the predetermined limited distance.

30. The system of claim 29, wherein the sensor comprises a first permanent magnet and a first reed switch.

31. The system of claim 30, wherein the a first reed switch is configured to be mounted to the door frame such that when the door is closed the permanent magnet is brought sufficiently adjacent the first reed switch to energize said first reed switch, the first permanent magnet being located in a first direction relative to said first reed switch; and a second reed switch configured to be mounted to the door frame near the first reed switch, such that when the door is closed said permanent magnet does not energize the second reed switch, and such that a second permanent magnet having sufficient strength to energize said first reed switch from a direction other than said first direction will also energize said second reed switch; and a detector for detecting a tamper condition when said second reed switch is activated.

32. The system of claim 31, further comprising a timer connected to the sensor and configured for indicating elapse of a predetermined time period after opening of the door within the predetermined limited distance;

whereby the electromagnet can be de-energized upon indication from the timer after a predetermined time period after the door is opened within the predetermined limited distance.

33. An emergency exit door lock system configured for use with a door mounted in a door frame, the system being configured for sensing when a person attempts to open said door, and for allowing said door to open after a subsequent delay, the system comprising:

a magnetic lock configured for preventing said door from opening, said lock including an electromagnet configured to be mounted on said door frame and an armature configured to be mounted on said door facing said electromagnet;

an inertia absorbing elastically deformable connection at least partially housed within said door and configured to mount said armature on said door, said connection allowing a predetermined limited movement of said door relative to said armature and biasing said armature and said door toward a first relative position adjacent one another, said connection including lost motion arrangements connected to the armature and coupled to said door when the connection is mounted thereto and an elastic biasing member at least partially housed within said door and configured for resisting relative movement between the lost motion arrangements and said door to which said elastic biasing member is configured to be mounted, the connection allowing relative movement of said door and the armature against resistance provided by the elastic biasing member;

a sensor configured to be mounted to said door frame for sensing when said door has been urged by an external force away from said fully closed position to an activation position;

a controller coupled to said sensor, the controller being configured to provide an alarm signal in response to operation of said sensor sensing when said door has been moved away from said fully closed position to an activation position, and for providing a door unlock signal to de-energize said electromagnet at the end of a predetermined egress delay period; and said system including arrangements for blocking access to said connection to preclude tampering with or interference with the delayed opening of said door.

34. An emergency exit door lock system configured to cooperate with a door mounted in a door frame, the system being configured for sensing when a person attempts to open said door, and for allowing said door to open after a subsequent delay, the system comprising:

a magnetic lock configured for preventing said door from opening, said lock including an electromagnet configured to be mounted on said door frame and an armature configured to be mounted on said door facing said electromagnet;

an inertia absorbing elastically deformable connection at least partially housed within said door and configured to mount said armature on said door, said connection allowing a predetermined limited movement of said door relative to said armature and biasing said armature and said door toward a first relative position adjacent one another, said connection including a plunger at least partially housed within said door, connected to the armature, and configured for extending into said door when the connection is mounted thereto and an elastic biasing member configured for resisting relative movement between the plunger and said door in which said elastic biasing member is configured to be mounted, the connection allowing relative movement of said door and the armature against resistance provided by the elastic biasing member;

a sensor configured to be mounted to said door frame for sensing when said door has been urged by an external force away from said fully closed position to an activation position;

a controller coupled to said sensor, the controller being configured to provide an alarm signal in response to operation of said sensor sensing when said door has been moved away from said fully closed position to an activation position, and for providing a door unlock signal to de-energize said electromagnet at the end of a predetermined egress delay period; and said system including:

a hollow shaft for extending at least substantially through said door, said plunger being mounted within said hollow shaft, and said elastic biasing member constituting a coil spring configured for mounting wholly within said hollow shaft, said coil spring being mounted on said plunger, said plunger having a head thereon at the end thereof away from said armature, and said spring being confined between the head of said plunger and a stop included within said hollow shaft;

whereby said door may move a substantial distance while the armature is in engagement with the electromagnet.

35. An emergency exit door lock system as defined in claim 34 wherein said coil spring is compressed when pressure is applied to said door, and wherein the difference in length between the compressed and uncompressed length of said coil spring is at least equal to one centimeter.

* * * * *